United States Patent [19]

Bernardis et al.

[11] Patent Number: 4,995,743

[45] Date of Patent: Feb. 26, 1991

[54] WIRE PRINTER WITH STEP FORMATION ARMATURE AND METHOD OF ASSEMBLY

[75] Inventors: Francesco Bernardis, Chiaverano; Claudio Marangon, Borgofranco D'Ivrea; Rinaldo Ferrarotti, Ivrea, all of Italy

[73] Assignee: Ing. C. Olivetti & C., S.p.A., Ivrea, Italy

[21] Appl. No.: 289,840

[22] Filed: Dec. 27, 1988

[30] Foreign Application Priority Data

Dec. 29, 1987 [IT] Italy ..... 68141 A/87

[51] Int. Cl.[5] ..... B41J 3/12

[52] U.S. Cl. ..... 400/124; 101/93.05; 29/602.1

[58] Field of Search ..... 400/124; 101/93.05; 29/602.1

[56] References Cited

U.S. PATENT DOCUMENTS

| | | | |
|---|---|---|---|
| 3,893,220 | 7/1975 | Bittner | 400/124 X |
| 4,230,038 | 10/1980 | Herbert | 400/124 X |
| 4,389,127 | 6/1983 | Bellinger | 400/124 |
| 4,407,591 | 10/1983 | Adamoli | 400/124 |
| 4,420,266 | 12/1983 | Kolm | 400/124 |
| 4,583,871 | 4/1986 | Ochiai | 400/124 |
| 4,626,115 | 12/1986 | Norigoe | 400/124 |
| 4,629,343 | 12/1986 | Bernardis | 400/124 |

*Primary Examiner*—Eugene H. Eickholt

*Attorney, Agent, or Firm*—Banner, Birch, McKie & Beckett

[57] ABSTRACT

Each needle of the printer has an associated electromagnet with a generally elongate movable armature having a first end and a second end which can selectively push the needle during printing as a result of a pivoting movement within a step formation facing the electromagnet. The step formation divides the armature into first and second portions facing the first and second ends respectively, and faces the respective electromagnet in such a position that the second portion of the armature at least partially faces the electromagnet.

24 Claims, 6 Drawing Sheets

WIRE PRINTER WITH STEP FORMATION ARMATURE AND METHOD OF ASSEMBLY

DESCRIPTION

Figure 1:
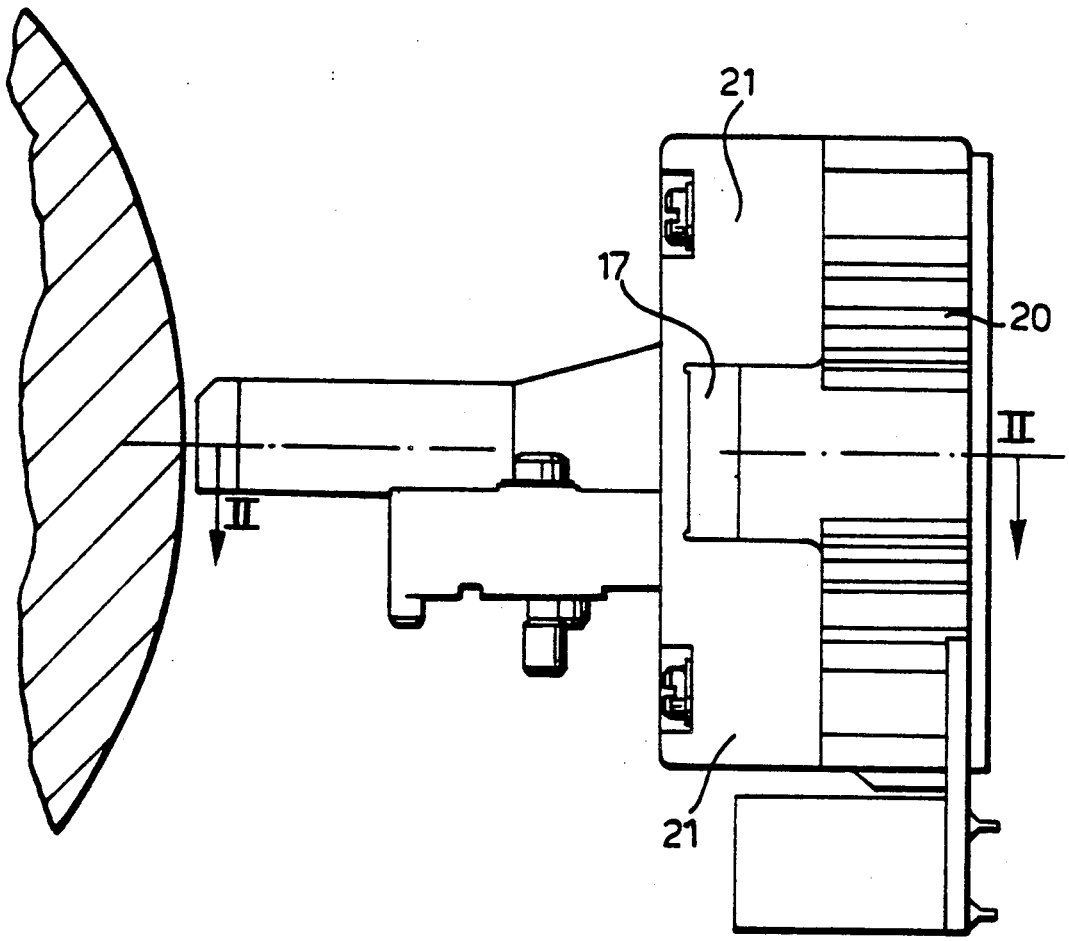

The present invention relates to printers with needles (or wires).

Printers of this type and their components are widely known in the art and are described, for example, in U.S. Pat. Nos. 4,624,589 and 4,626,115 as well as in the U.S. Pat. No. 4,629,343 in the name of the same Applicant.

In order, to produce these printers, it is necessary to try to reconcile various conflicting requirements including:

the need to make the dimensions and therefore the inertial mass of the printer as small as possible, so as to ensure its cooling during operation, and at the same time seeking to increase the number of needles of the printer for the purposes of print quality, the need to make the printing quality of the individual needles as uniform as possible, without variations in the behaviour of different needles within the printer, and the need to make the manufacture of the printer as simple as possible and to enable the maximum possible automation thereof.

In the latter connection, it is considered advantageous for the assembly and operating conditions of the needles and their operating members (electromagnets, armatures, etc.) to be checked before the assembly of the printer so that it is possible to replace only the elements which are considered defective, without the need necessarily to reject the whole printer.

The object of the present invention is to provide a printer with needles (or wires) which responds best to these requirements.

A first aspect of the present invention concerns a needle printer in which each needle is associated with an electromagnet having a generally elongate armature with first and second ends which can selectively push the needle during printing as a result of a pivoting movement of the armature with movement of the first end towards the electromagnet and movement of the second end away from the electromagnet, characterised in that the armature has a step formation which faces the electromagnet and is intended to act as a fulcrum for the pivoting movement, the step formation dividing the armature into first and second portions which face the first and second ends respectively, and facing the respective electromagnet in such a position that the second portion of the armature at least partially faces the electromagnet and defines a gap relative thereto.

For given overall dimensions (length) of the armature, this solution enables a certain increase to be achieved in the pivoting movement between the first portion of the armature (which is the one that entirely faces the electromagnet) and the second portion which acts as the arm for operating the printing needle.

A second aspect of the present invention concerns a printer including a plurality of printing needles, a corresponding plurality of electromagnets with respective excitation conductive wires and movable armatures for selectively pushing the needles during printing, and a body for housing the electromagnets with a mass for holding the electromagnets in the housing body, which is introduced in the liquid state and then hardened within the housing body, characterised in that:

the housing body is generally cup-shaped with a mouth part and a base wall with apertures for the passage through the base wall of the conductive wires for the excitation of the electromagnets, and a closure device is associated with the base wall and is provided with generally tubular appendages which extend into the apertures so as to close the apertures and surround the conductive wires, the appendages surrounding the conductive wires in such a way as to prevent the escape of the holding mass from the container body when it is in the liquid state.

The invention also concerns a method for the manufacture of a printer including a plurality of printing needles, a corresponding plurality of electromagnets with respective excitation conductive wires and movable armatures for selectively pushing the needles during printing, a body for housing the electromagnets, and a mass for holding the electromagnets, which can be introduced into the housing body in the liquid state and then hardened within the housing body, characterised in that it includes the steps of:

the provision of a housing body in the form of a generally cup-shaped body with a mouth part for the introduction of the holding mass and a base wall with apertures for the passage through the base wall of the conductive wires for the excitation of the electromagnets, the association with the base wall of a closure element provided with generally tubular appendages which extend into the apertures so as to close the apertures, and have internal cavities for the passage of the conductive wires surrounded thereby, the insertion of the electromagnets into the housing body, the conductive wires of each electromagnet being made to pass through the respective appendages of the closure element, the pouring of the holding mass into the housing body in the liquid state, and the hardening of the holding mass.

Figure 2:
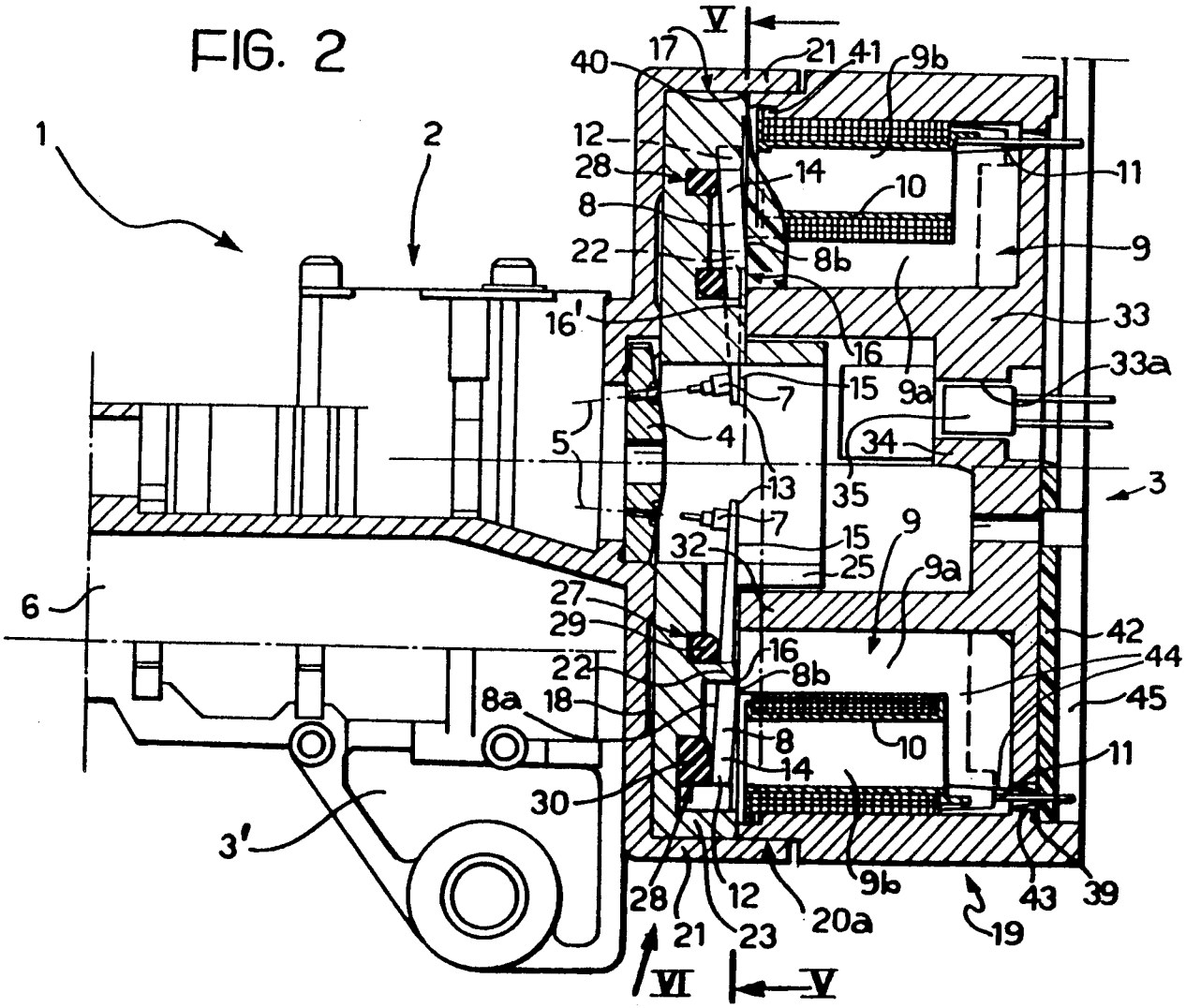
Figure 3:
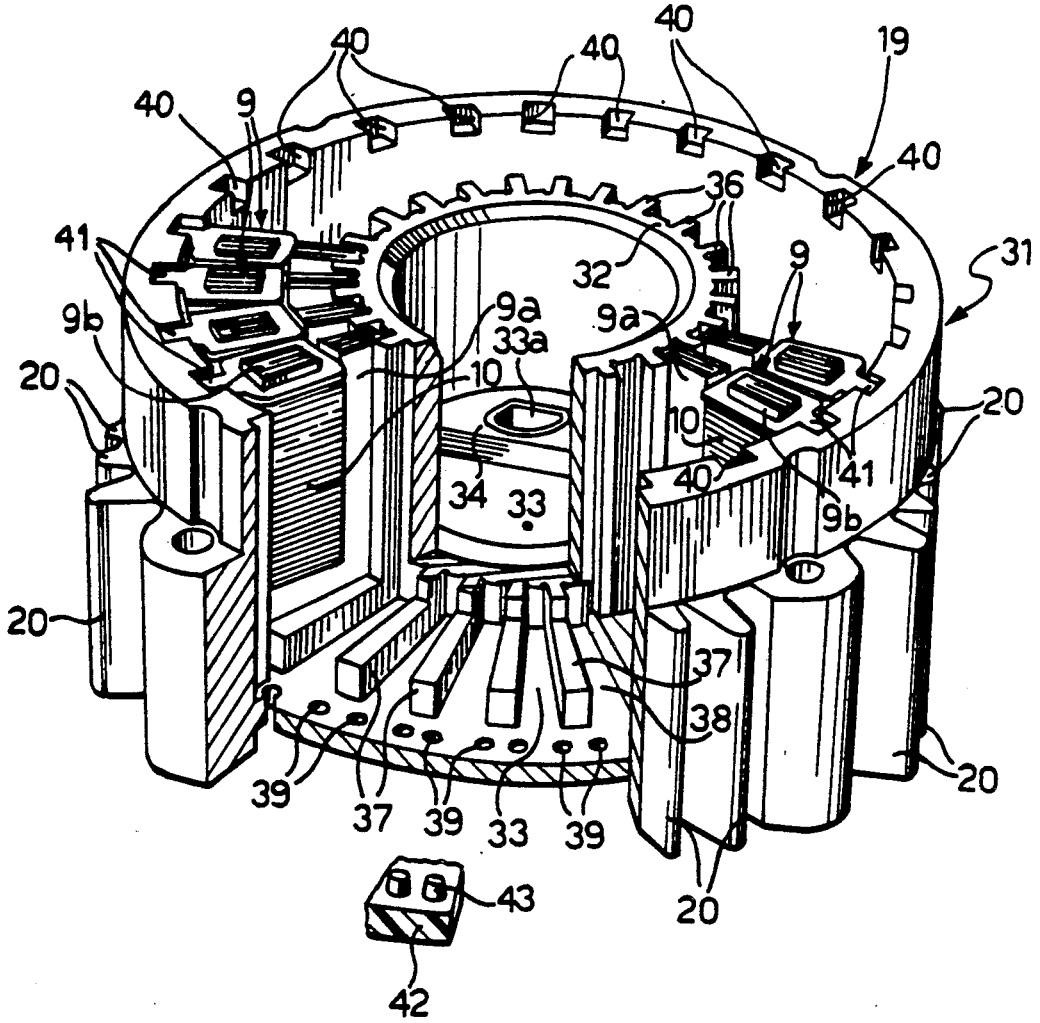
Figure 4:
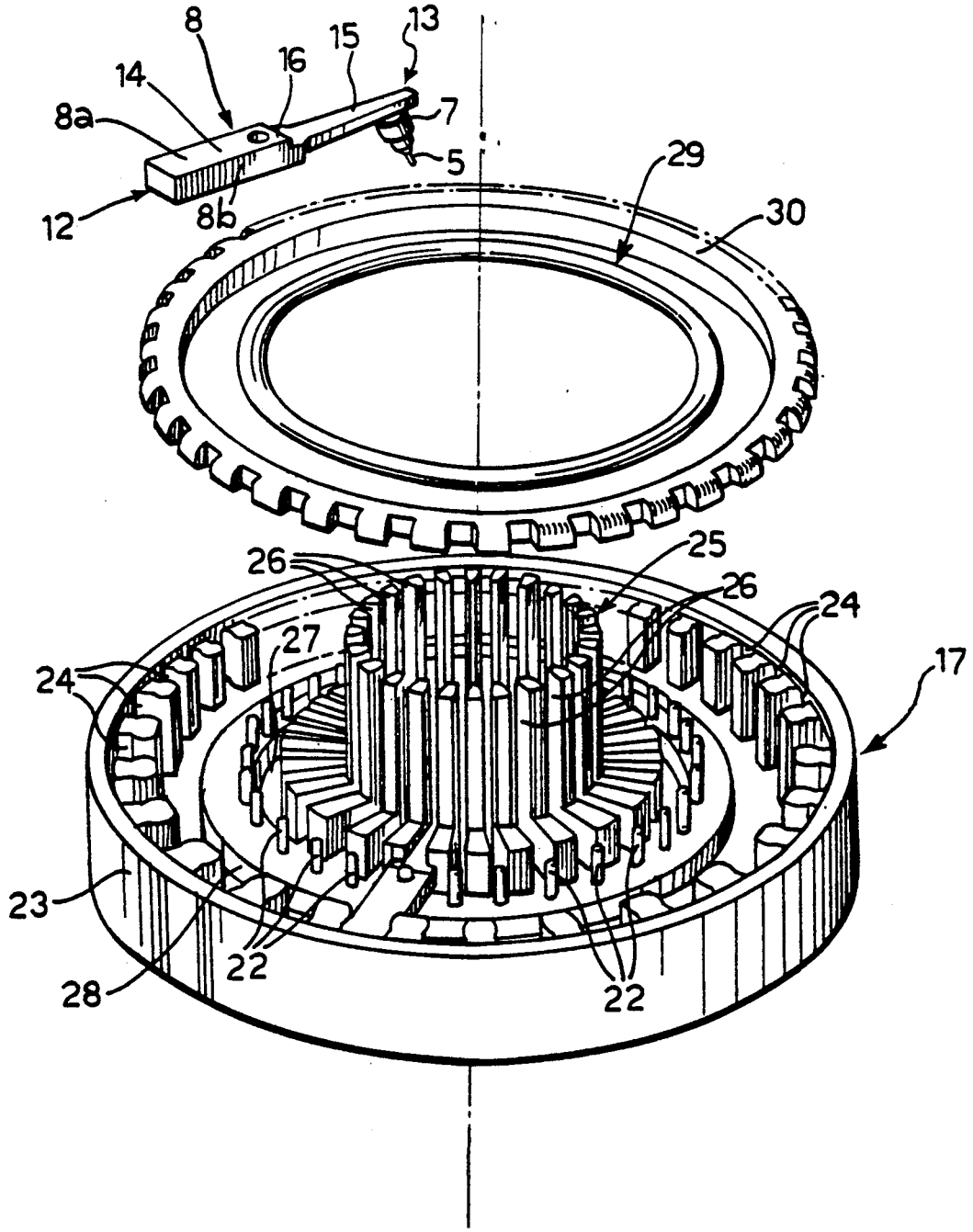
Figure 5:
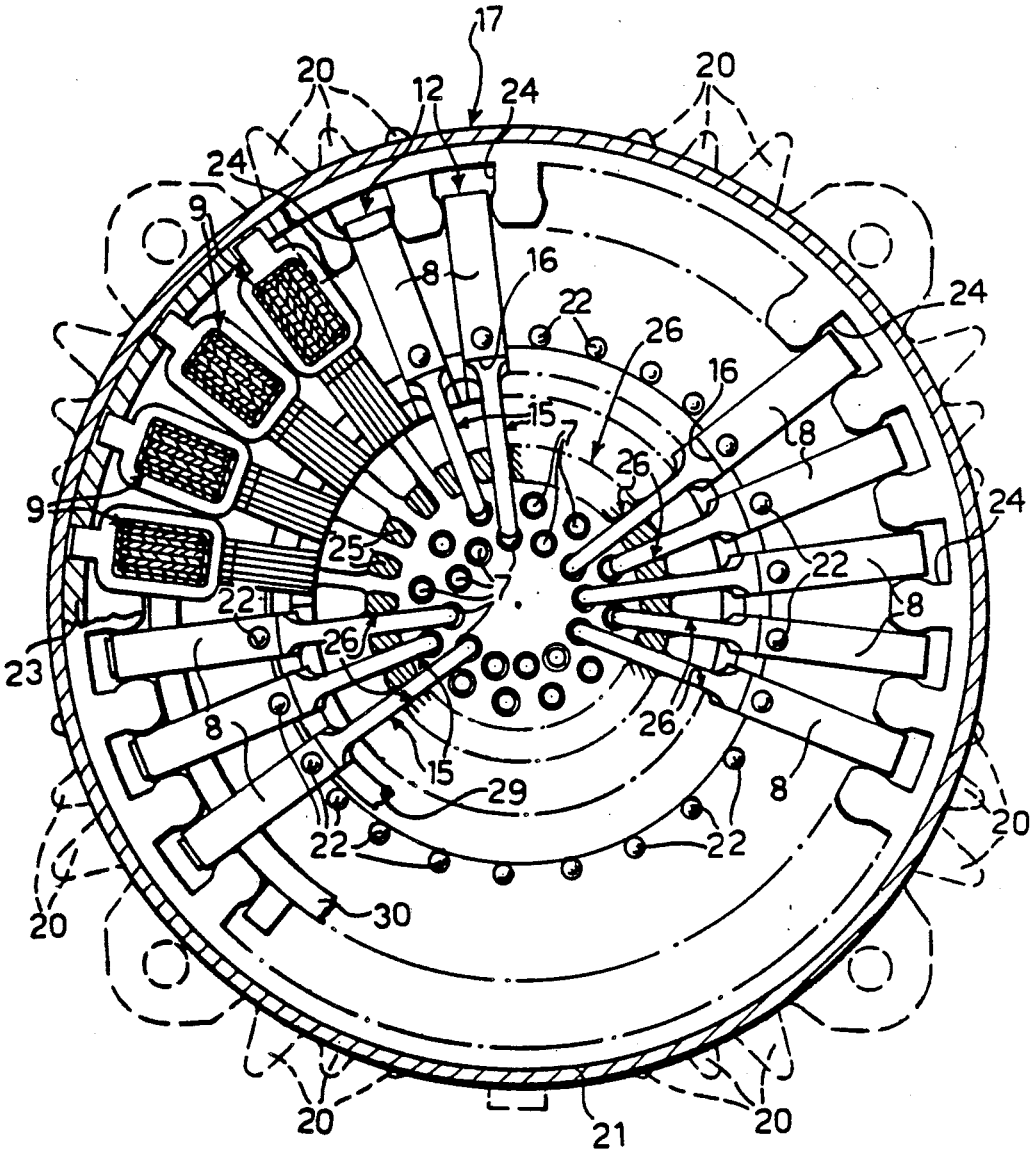
Figure 6:
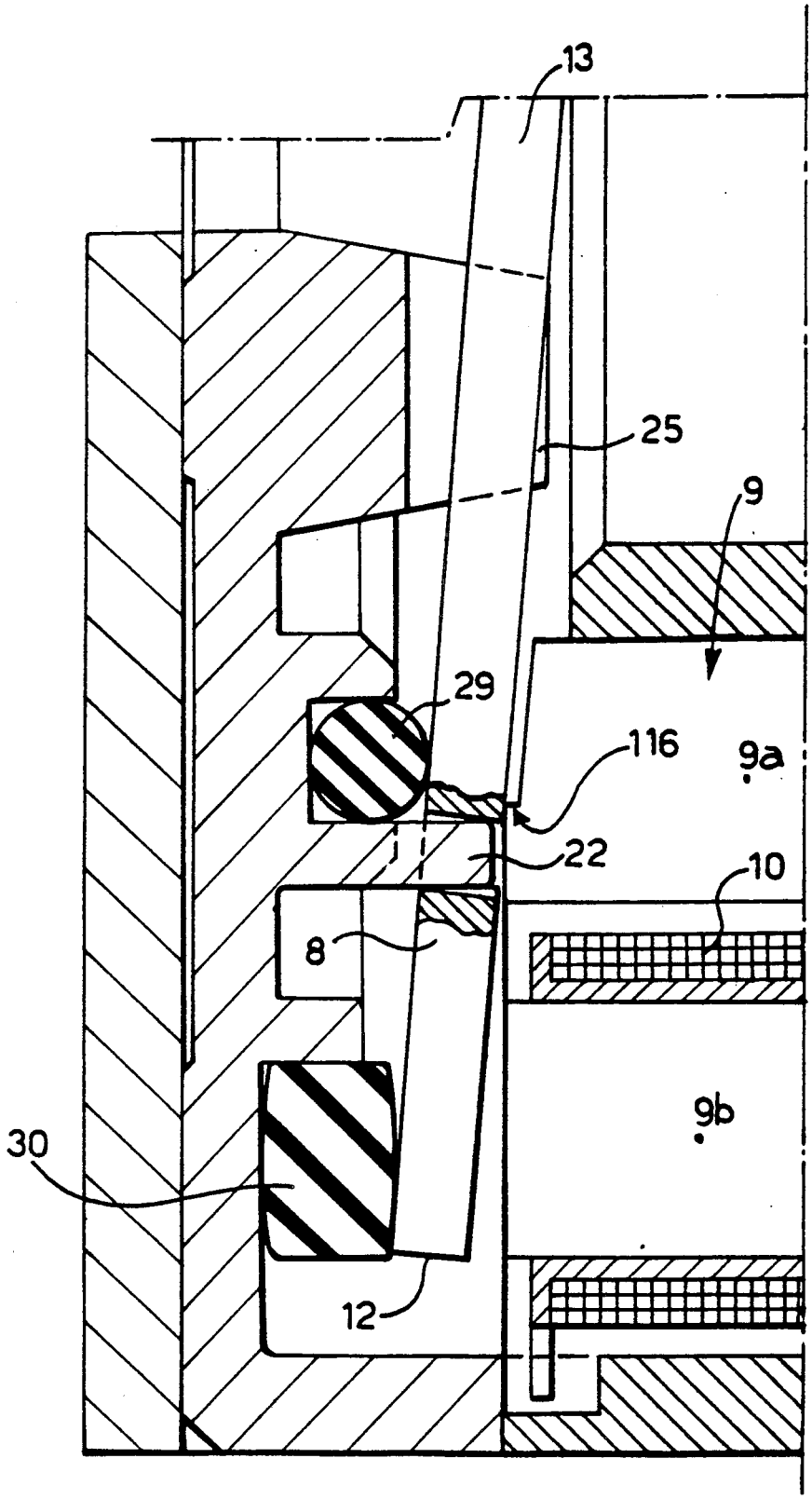

The invention will now be described, purely by way of non-limiting example, with reference to the appended drawings, in which:

FIG. 1 is a side elevational view of a printer with wires or needles according to the invention, FIG. 2 is a section taken on the line II—II of FIG. 1, FIG. 3 is a perspective view of one of the elements illustrated in FIGS. 1 and 2, FIG. 4 is a perspective view of another of the elements illustrated in FIGS. 1 and 2, FIG. 5 is a section taken on the line V—V of FIG. 2, and FIG. 6 is a view of the part indicated VI in FIG. 2, on an enlarged scale, showing a possible variant.

In the drawings a printer (head) with needles or wires is generally indicated 1.

The general operating criteria of these printers are considered widely known in the art and will not therefore be reconsidered in detail herein. As basic information, it should be noted that the terms needles and wires, as used with reference to the present invention, are considered wholly equivalent. For this reason, although the term "needles" is used for preference in the present description and in the claims which follow, it is understood that this term also embraces the term "wires".

Two parts can generally be distinguished in the printer 1, namely:

a front part (nose) 2 intended to face the printing surface (not illustrated), and a generally cylindrical rear part 3 containing the operating members of the printer 1.

The front part or nose 2 is substantially constituted by a tubular casing provided with lateral flanges 3' for the fixing of the printer 1 to the carriage which moves it to and fro in front of the printing surface during printing. Two transverse walls or templates 4 are provided within the nose 2 and have openings which support a plurality of printing needles or wires made from a metal, such as tungsten, steel alloyed with chrome or cobalt, or the alloy currently known as widia.

The needles 5 extend from rear or inner ends towards a printing mask 6 situated at the free front end of the nose 2, towards which the ends of the needles face to form a matrix of printing points. Mushroom-shaped covering caps 7 are fitted on the inner ends.

As can better be seen in the section of FIG. 5, the inner ends of the needles 5 and their caps 7 are arranged alternately in two concentric circular arrays of different radii.

Printing is achieved, in widely known manner, as a result of a percussive or pushing action exerted on the inner ends of the needles 5, causing them to move forwards so that their front ends project through the printing mask 6 towards the printing surface.

The needles 5 are moved by pivoting arms 8 which are arranged in a circular array in a generally star-like arrangement.

Each pivoting arm 8 constitutes the movable armature of a respective electromagnet 9 constituted by a generally U-shaped pack of iron-silicon or iron-chrome plates. The pack of plates is arranged within the rear part 3 and includes two arms 9*a* and 9*b* located respectively in inner and outer positions relative to the printer 1.

Excitation coils 10 are fitted onto the outer arms 9*b* of the electromagnets 9 and each is provided with two respective supply conductive wires 11. The latter are preferably arranged at the side of the coil 10 which faces the outside of the electromagnet 9, at the end of the latter opposite the end at which the movable armature 9 is situated.

The armatures 8 are constituted by parts which are stamped or blanked from a ferromagnetic material, such as an iron-cobalt alloy. In the armatures 8 can generally be seen a first end 12 faces the outside of the device, and a second end 13 which faces the inside of the printer 1 and is intended to act on the needles 5.

As can better be seen in FIG. 2, each armature 8 can thus be considered to be divided into a first, radially outer portion 14 which is approximately comparable to a plate, and a second, radially inner portion 15 constituted by a narrower arm which is cantilevered from the first portion 14.

In the embodiment illustrated, all the armatures 8 are identical as regards their conformation and the dimensions of their outer portions 14. The lengths of the inner portions 15 which act on the needles 5, however, are different. The ends of these portions, which carry the caps 7, are in fact arranged in alternately in two circular rings of different radii.

Armatures with inner portions 15 of different lengths are therefore provided in a corresponding alternating sequence in the array of armatures 8 (FIG. 5), so as to be able to act on the respective ends 7 of the corresponding needles.

Returning to the cross-section of FIG. 2, there can be distinguished in each armature 8*a* first face 8*a* which is situated outwardly of the electromagnets 9, that is, facing the nose 2, and a second or inner face 8*b* which faces towards the electromagnets 9. On its face 8*b*, each armature 8 has a step formation 16 (see also FIG. 4) which essentially separates the outer portion 14 of each armature from its inner portion 15.

The step 16 of each armature 8 bears against the respective electromagnet 9, and more precisely against its inner arm 9*a*, with the interposition of a sheet 16' of mylar, whose thickness cannot be perceived in the drawings.

As a result of the presence of the step formation 16, the outer part 14 of the armature 8 is thicker (axially of the device, that is, in the direction of the needles 5) than the inner portion 15.

Each armature 8 can therefore pivot about the step formation 16 which acts as a fulcrum. This pivoting movement can be driven positively by the excitation of the electromagnets 9.

In fact, when an electromagnet 9 is excited by the supply of its coil 10 through the conductive wires 11, the magnetic circuit including the armature 8 is brought to a condition of minimum reluctance. The outer end 12 and the outer portion 14 as a whole are therefore attracted towards the outer arm 9*b* of the electromagnet, causing the armature 8 to pivot in the sense which moves the inner portion 15 of the armature away from the electromagnet 9 and from its inner arm 9*a* in particular.

The outer portion 15 of the armature 8 therefore acts on the corresponding needle 5, causing it to be projected forwards towards the printing position.

In the printer according to the invention, the armature 8 is mounted in such a way that the step formation 16 located is approximately in the middle (radially) of the inner arm 9*a* of the electromagnet 9 by means of a positioning formation, as will be described below.

This means that the inner portion 15 of each armature is at least partially exposed to the action of the electromagnet. In other words, when the electromagnet is excited, the inner portion 15 of the armature 8 also tends to be attracted towards the electromagnet 9. However, this force of attraction is greatly exceeded and overcome by the force of attraction which acts on the outer portion 14.

The solution described has the advantage that, within the range of the pivoting movement of the armature 8, it enables the amplitude of the movement of the inner end 13 which acts on the needles 5 to be greater than the amplitude of the movement of the outer end 12.

This result is achieved by making the armature 8 in such a way that its inner portion 15 (the distance between the end 13 and the step formation 16) is longer—by a ratio typically between 1.3 and 1.8—than the outer portion 14 (the distance between the step formation 16 and the outer end 12).

The location of the step formation 16 approximately in the middle of the radial extent of the inner arm 9*a* of the electromagnet 9 is considered the best for achieving the greater movement and simultaneously preventing the attraction exerted on the inner portion 15 of the armature 8 by the electromagnet 9 from adversely affecting the speed of the pivoting movement of the armature 8 as a whole.

Examined in greater detail, the rear part 3 of the printer 1 may in turn be considered as being composed of two parts, that is to say:

a front disc-shaped supporting body 17 to which the nose 2 is connected by means of a flanged portion 18, and a generally cup-shaped housing body 19 within which the electromagnets 9 are mounted.

In general, the front support body 17 is made of a moulded plastics material, whilst the housing body 19, like the nose 2, is made of metal, such as die-cast aluminium.

This is considered the best choice as regards the dissipation of the heat which is generated in the printer 1 during operation.

The nose 2 in fact enables some of the heat to be dissipated through the connecting flanges 3' towards the carriage which moves the printer 1.

The housing 19, however, may advantageously be provided with radial fins 20 which also have a cooling function due to the movement of the printer during printing.

At least on part of its radial extent, the flanged part 18 of the nose 2 preferably has a cylindrical formation 21 which surrounds the peripheral wall **20*a* of the housing body 19** and is in direct contact therewith.

The two metal parts of the printer are thus connected for the transmission of heat, which generally facilitates the dissipation of heat to the outside.

The support body 17 is made of plastics material and has the main purpose of keeping the armatures 8 precisely in their general ray-like arrangement and also of guiding their pivoting movement about the respective step formations 16 as a result of the excitation of their controlling electromagnets 9.

The body 17 also has the purpose of ensuring the correct positioning of the armatures 8 relative to the excitation electromagnets 9, particularly as regards the distance (gap) which separates the outer portions 14 of the armatures 8 from the electromagnets in the absence of excitation. This distance must be as uniform as possible for all the armatures 8. For this purpose, the support body 17 is made generally cup-shaped with a ring of pins 22 which are intended to extend through corresponding holes provided in each armature 8 closely adjacent the step formation 16.

The peripheral wall 23 of the support body 17 has a plurality of notches 24 which act as seats for housing the outer ends 12 of the armatures and guiding their movement.

The body 17 is also provided centrally, that is, approximately in line with the nose 2, with a central tubular hub 25 having axial slots 26 (FIG. 2) each of which houses the inner end 15 of a respective armature 8.

Two guide formations and one radial positioning formation are thus provided for each armature 8 in the printer according to the invention, that is to say:

a first guide formation which is constituted by the notch 24 in the peripheral wall of the support body 17 and regulates the movement of the outer end 12 of the armature, a second guide formation which is constituted by the slot 26 in the hub 25 of the support element 17 and guides the movement of the inner end 13 of the armature, and a positioning formation which is constituted by the pin 22 and keeps the armature 8 in a well-defined radial position in correspondence with the pivoting fulcrum defined by the step formation 16.

The functions of guiding and positioning the armature 8 and its pivoting, as described, are achieved by means of metal-plastics couplings which reduce the wear of the parts and particularly the formation of magnetisable metal powders (fretting corrosion) in the gap, which could reduce the working stroke of the armature 8.

The solution described also ensures that the movement of the armatures 8 can be adjusted precisely without any transverse pivoting of the various armature 8 relative to their movements for operating the needles 5.

As has been seen, the support body 17 also has the function of ensuring the correct positioning of the armatures 8 longitudinally and axially of the printer 1, so that all the armatures 8 occupy substantially identical positions relative to the electromagnets 9 which operate them.

For this purpose, the support body 17 is provided with two annular grooves or recesses, an inner one and an outer one 27, 28 respectively, which open towards the mouth part of the support body 17, that is to say, the part which is intended to face the electromagnets 9.

The recess 27 extends near the step formations 16. More precisely, the outer side of the recess 27 extends around a circle which practically corresponds with the circle around which the step formations 16 of the armatures 8 and the inner parts of the pins 22 are aligned.

A resilient element (an 0-ring) 29 with a Shore A hardness of the order of 35 is mounted in the recess 27 and is constituted by a resilient silicon material with very low "creep" and the ability to withstand temperatures up to 140° without losing its particular characteristics.

The outer recess 28 is situated adjacent the outer ends 12 of the armature 8, and hence in correspondence with the notches 24, and a ring 30 provided along its outer edge with teeth than can extend into the notches 24 beneath the outer ends 12 of the armatures 8 is mounted therein.

The ring 30 is made of a viscoelastic material which can retain its characteristics up to temperatures of the order of approximately 140°, constituted, for example, by a fluorelastomeric material having a Shore A hardness of 75 (± 5).

The function of the inner ring 29, which is usually circular in cross-section, is to act on the front parts 15 of the armatures 8 to encourage them to return to the rest position, that is to say, the position in which the outer portion 14 is spaced from the electromagnet 9 and forms a space or gap of fixed width with respect to the outer arm **9*b*** of the electromagnet.

The function of the outer ring 30 is essentially to form a stop surface for the outer parts 14 of the armatures 8 so that the gap is as uniform as possible for all the armatures 8, preventing any difference in the projection of the needles 5 towards the printing position from armature to armature.

The viscoelastic nature of the material constituting the ring 30 means that the return movement of the armatures 8 to the rest position after the relative electromagnet 9 has been de-energised takes place without bouncing, so that each armature 8 returns immediately to its starting position ready to carry out another printing operation.

The ring 30 préferably has a rectangular cross-section, as can clearly be seen in FIG. 2 which shows the cross-section of the ring 30 in correspondence with a tooth which extends into one of the notches 24.

The face of the ring 30 which faces towards the armature 8 preferably has a rounded cross-section of generally circular outline. This choice is considered the best for ensuring correct contact with the outer portion 14 of the armature 8 and an adequate damping action.

The generally cup-shaped configuration of the support element 17 and the presence of the central hub 25 facilitate the coupling of the body 17 to the housing body 19. The good electrical conductivity of the two bodies 18 and 19 prevents the accumulation of electrostatic charges in the body 2.

Moreover, the fact that the armatures 8 are located in correspondence with the mouth part of the support body 17 means that it is possible to check the correct mounting of the armatures 8, particularly as regards the width of the gap defined by the outer parts 14 relative to the electromagnets 9, before assembly with the housing body 19.

In fact, the body 17 is made so that the plane of its top (that is, the imaginary plane defined by the edge of its mouth part) corresponds exactly to the frontal plane which the electromagnets 9 mounted in the housing body 19 face when the device is assembled.

The checking of the positions assumed by the armatures 8 relative to the plane of the mouth of the support body 17 by means of simple feelers, not shown in the drawings, thus enables the positions which the armatures 8 will assume relative to the excitation electromagnets to be identified before the final assembly of the device.

Any anomaly detected in the positioning of an armature can therefore be corrected, or the armature perhaps replaced, before the device is assembled. The subsequent discarding of a complete assembled device because of a defect or an error in the mounting of an armature 8 can therefore be avoided.

The housing body 19, shown in the perspective view of FIG. 3, is also cup-shaped.

More precisely, within the body 19, there can be seen a peripheral wall 31, a central hub 32 and a base wall 33 in the shape of a ring which connects the peripheral wall 31 to the central hub 32.

There is usually an aperture 33*a* through the base wall 33, within the hub 32, which enables a temperature-monitoring device 35 to be fitted.

On its outer wall, the hub 32 has radial ribs 36 which extend axially relative to the hub 32 and are extended on the upper face of the base wall 33 by triangular formations 37 which diverge generally from the wall of the hub 32 towards the peripheral wall 31 of the body 19.

The formations 36 and 37 define between them generally L-shaped notches 38 which enable the electromagnets 9 to be inserted in the housing body 19 and ensure their correct location in a generally ray-like arrangement.

As has been seen (see particularly FIG. 2), each electromagnet 9 is generally U-shaped with an inner arm 9*a* and an outer arm 9*b* onto which the excitation winding 10 is fitted. The conductive wires 11 which enable the winding 10 to be supplied project from the electromagnet 9 in correspondence with the outer end of its base part. The conductive wires 11 thus face the base wall 33 of the housing body 19 closely adjacent the outer wall 31.

In the region in which the conductive wires 11 are situated, the base wall 33 is provided with apertures 39 situated in a ring at the base of the outer wall 31 of the body 19. A conductive wire 11 is intended to pass through each aperture 39. Two apertures 39 are therefore present in correspondence with each formation 38 for housing a respective electromagnet 9, for the passage of the two conductive wires for energising the winding 10 of the electromagnet.

The electromagnets 9 can thus be slid easily into the body 19 until the supply conductive wires 11 pass through the corresponding pair of apertures 39 in the base wall 33.

The longitudinal sliding of each electromagnet is guided by the ribs 36 provided on th outer surface of the hub 32. The side of the inner arm 9*a* of each electromagnet 9 actually slides within the groove defined by two adjacent formations 36.

The exact orientation radially of the body 19 is ensured by the engagement of the base part of the electromagnet 9, that is, the end opposite the end which is intended to cooperate with the armature 8, in the channel defined by two adjacent formations 37.

Further guide formations constituted by notches 40 provided along the inner side of the free edge of the body 19 house a tooth-like formation 41 provided on each electromagnet in correspondence with the upper end of the outer arm 9*b*.

It is thus possible to ensure that each electromagnet 9 is located and kept precisely in the desired mounting position and to avoid any adverse effects which could result from the bad positioning of the pack of plates relative to the armature 8, etc.

A closure element of plastics material, such as polytetrafluoroethylene, indicated 42, is fitted to close the base wall 33 of the housing 19.

The body 42 is generally disc-shaped and has appendages 43 along its outer edge which are generally tubular in shape and can extend into the apertures 39 to close them.

The appendages 43 extend into the apertures 39 so as to close the latter and to surround the conductive wires 11 of the windings 10 of the electromagnets.

For this purpose, the appendages 43 have tapered through-holes which diverge towards the inside of the housing body 19.

This general tapered configuration has the advantage that it guides the conductive wires 11 in their movement through the apertures 39 during the fitting of the electromagnets in the body 19.

The appendages 43 must surround the conductive wires 11 in such a way that it is not too difficult to insert the electromagnets in the body 19 as a result of friction. At the same time, they must prevent the holding mass 44 for firmly holding the electromagnets 9 in the housing body 19 (according to a known solution) from accidentally escaping from the latter.

This holding mass or resin is poured into the body 19 in the liquid state and is then cured within the body, for example, by means of heat treatment.

The solution adopted in the printer according to the invention (the generally cup-shaped configuration of the housing body 19 and the presence of the appendages 43 which close the apertures 39 but allow the passage of the conductive wires 11) enables the holding mass to be introduced into the housing body 19 under particularly favourable conditions.

Unlike prior-art solutions which require the use of holding masses which retain a certain viscosity even in the liquid state, in the solution according to the invention, it is possible to use as the filler mass a resin such as that sold by the company Ciba-Geigy under the trademark ARALDIT CW 1302 GB, treated with a hardener HV 932. When this resin is in the liquid state, it has a negligible viscosity which is practically comparable to that of water and enables it to be poured into the body 19 by gravity, that is, without the need to apply an injection pressure. The low viscosity of the holding mass also facilitates its complete penetration into all the spaces within the housing body 19.

In any case, the holding mass 44 does not escape through the apertures 39 closed by the tubular appendages 43 of the closure body 42 since, as has been seen, the dimensions of the axial cavities of the tubular appendages are selected so as to prevent the escape of the holding mass from the housing body.

The same holding mass, which is poured into the body 19 at ambient temperature, can then subsequently be cured by heat, for example by heating to approximately 120° C. for a period of approximately 4 hours.

This temperature is not such as to damage the other parts which make up the housing body 19.

Once the holding mass has set, the face of the housing body 19 (with the electromagnets 9 situated therein) which is intended to face the armatures 8 is subjected to a finish operation (lapping) for removing any projections on this face, so that the ends of the arms 9*a*, 9*b* of all electromagnets 9 are brought into exactly the same plane, which is that in which the pivoting movement of the armatures 8 mounted in the support body 19 must take place.

A printed electrical circuit 45 provided with metallised tracks which come into contact with the respective conductive wires 11 of the electromagnets 9 can then be applied to the closure body 42. The secure positioning of the disc 42 relative to the conductive wires 11 is such as to align the conductive wires precisely with the corresponding contacts of the printed circuit for easy and reliable assembly.

The printer 1 illustrated in the appended drawings includes twenty-four printing needles with a corresponding number of excitation units (electromagnet 9, armature 8).

The solution according to the invention, however, lends itself to the production of printers comprising a greater number of needles, for example forty, without this causing a substantial increase in the overall dimensions of the printer. This can be attributed, amongst other things, to the selected location of the step formations 16 in positions which are not marginal with respect to the electromagnets 9 and to the mounting of the excitation windings 10 on the outer arms 9*b*of the electromagnets 9.

The assembly sequence just described also lends itself advantageously to the production of the variant illustrated in FIG. 6. In this variant, the reference numerals which have already been used in other drawings refer to parts of the printer which are structurally and/or functionally identical to those already described. The main difference in the case of the variant of FIG. 6 is the replacement of the step formation 16 provided on each armature 9 by a step formation 116 provided on the inner arm 9*a* of the electromagnet facing it.

What is claimed is:

1. A method for the manufacture of a printer including a plurality of printing needles, a corresponding plurality of electromagnets with respective excitation conductive wires and movable armatures for selectively pushing the needles during printing, a body for housing the electromagnets, and a mass of bistate material for pouring into the housing body in a liquid state and holding the electromagnets in the housing body in a hardened state, wherein the method includes the steps of:

providing a housing body in the form of a generally cup-shaped body with a mouth part for the introduction of the holding mass and a base wall with apertures for the passage through the base wall of the conductive wires for the excitation of the electromagnets, providing the housing body with an associated closure element provided with generally tubular appendages which extend into the apertures so as to close the apertures and have internal cavities for the passage of the conductive wires surrounded thereby, inserting the electromagnets in the housing body, the conductive wires of each electromagnet being made to pass through the respective appendages of the closure element, pouring the holding mass into the housing body in the liquid state, and hardening the holding mass.

2. A method according to claim 1, wherein the holding mass is poured into the holding body by gravity.

3. A method according to claim 1, wherein the holding mass is poured into the holding body substantially at ambient temperature.

4. A method according to claim 1, wherein, after the holding mass has hardened, it includes the operation of subjecting the mouth part of the housing body, with the electromagnets and the holding mass contained therein, to a finishing operation to form an end plane of pivoting for the armatures.

5. A printer comprising a plurality of printing needles, a corresponding plurality of electromagnets with respective excitation conductive wires and movable armatures for selectively pushing the needles during printing, a body for housing the electromagnets, and a mass of bistate material for pouring into the housing body in a liquid state and holding the electromagnets in the housing body in a hardened state, wherein:

the housing body is generally cup-shaped with a mouth part and a base wall defining apertures for the passage through the base wall, and a closure element is associated with the base wall and is provided with generally tubular appendages which extend into the apertures so as to close the apertures and surround the conductive wires; the appendages surrounding the conductive wires in such a way as to prevent the escape of the holding mass from the container when it is in the liquid state.

6. A printer according to claim 5, wherein the appendages have inner cavities, the cavities generally conically-shaped such that the largest diameter openings of the cones face towards the inside of the housing body.

7. A printer according to claim 5, wherein the closure element is in the shape of a flat disc with a face from which the generally tubular appendages project.

8. A printer according to any one of claim 5, wherein the apertures in the base wall of the housing body are arranged in a circle.

9. A printer according to any one of claim 5, wherein the movable armatures are located in correspondence with the mouth part of the housing body.

10. A printer according to any one of claim 5, wherein the closure element is fitted to the base wall of the housing body outside the latter, and an electrical circuit plate with contacts for the conductive wires is fitted to the closure element.

11. A printer according to claim 5, wherein the housing body has a central hub with an array of guide formations which project from the hub for the insertion of the electromagnets into the housing body.

12. A printer according to claim 11, wherein each of the guide formations is generally L-shaped with a first arm which extends axially along the hub and a second arm which extends from the hub radially of the housing body, in correspondence with the base wall.

13. A printer according to claim 12, wherein the housing body has notches around its mouth part, the notches defining guide formations for the fitting of the electromagnets into the housing body.

14. A printer with needles in which each needle is associated with an electromagnet having a generally elongate armature with first and second ends which can selectively push the needle during printing as a result of a pivoting movement of the armature with movement of the first end towards the electromagnet and movement of the second end away from the electromagnet, wherein the armature has a step formation which faces the electromagnet and forms a fulcrum for the pivoting movement, the step formation dividing the armature into first and second portions which face the first and second ends respectively, and facing the respective electromagnet in such a position that the second portion of the armature at least partially faces the electromagnet with a gap therebetween, a body of electrically conductive material for housing the electromagnet, a support body on which the armatures are arranged for guiding the pivoting movement of each armature, the support body comprising:

at least one first guide formation which acts on the first end of the armature;

at least one second guide formation which acts on the second end of the armature;

at least one positioning formation which acts on the armature closely adjacent the step formation;

the armature arranged with a homologous face opposite the electromagnet, wherein generally annular, resilient abutment means is provided for acting on the homologous face of the armature adjacent the step formation;

a peripheral wall which is provided on its inner side with notches, each of which constituting a first guide formation for a respective armature;

a central hub which is grooved by axial slots defining the positioning formations for respective armatures; and a ring of pins which extends in a position intermediate the peripheral wall and the central hub, with each pin protruding from the support body and facing the inner surface towards the corresponding electromagnet and constituting the positioning formation for a respective armature.

15. A printer with needles in which each needle is associated with an electromagnet having a generally elongate armature with first and second ends which can selectively push the needle during printing as a result of a pivoting movement of the armature with movement of the first end towards the electromagnet and movement of the second end away from the electromagnet, wherein the armature has a step formation which faces the electromagnet and forms a fulcrum for the pivoting movement, the step formation dividing the armature into first and second portions which face the first and second ends respectively, and facing the respective electromagnet in such a position that the second portion of the armature at least partially faces the electromagnet with a gap therebetween, said printer including a support body on which the armatures are arranged, the support body comprising, for guiding the pivoting movement of each armature: a peripheral wall which is provided on its inner side with notches, with each notch constituting a first guide formation which acts on the first end of a respective armature; a central hub which is grooved by axial slots defining positioning formations, with each slot constituting a second guide formation which acts on the second end of a respective armature; and a ring of pins which extends in a position intermediate the peripheral wall and the central hub, with each pin constituting a positioning formation which acts on a respective armature closely adjacent the step formation.

16. A printer according to claim 15, wherein the ratio between the length of the second portion of the armature and the length of the first portion is substantially between 1.2 and 1.8.

17. A printer according to claim 15, wherein the armatures are arranged in a generally ray-like arrangement with the first ends of the armatures arranged around a circle, and alternate armatures in the array have respective second ends arranged around two circles of different radii.

18. A printer according to claim 15, wherein the armatures are arranged on the support body with homologous faces opposite the electromagnets, and wherein first and second generally annular, resilient abutment means are provided for acting on the homologous faces of the armatures adjacent the step formation and the first end respectively; the second resilient abutment means being made of a viscoelastic material which can stop the pivoting movement of the armatures with a damping effect.

19. A printer according to claim 18, wherein the first and second abutment means are in the form of rings.

20. A printer according to claim 18 or 19, wherein the second abutment means have a face intended to face the armatures and a cross-section which is generally rounded in the plane of pivoting of the respective armature.

21. A printer according to claim 18, wherein the support body defines grooves for housing the first and second abutment means.

22. A printer according to claim 18, wherein the second abutment means are in the form of a ring provided with tooth-like projections which extend into the recesses constituting the first guide formations for the armatures.

23. A printer according to claim 15, wherein the support body has a mouth part which the armatures face, the mouth part lying in a plane substantially corresponding to the plane along which the ends of the electromagnets facing the armatures extend.

24. A printer with needles in which each needle is associated with an electromagnet having a generally elongate armature with first and second ends which can selectively push the needle during printing as a result of a pivoting movement of the armature with movement of the first end towards the electromagnet and movement of the second end away from the electromagnet, wherein the armature has a step formation which faces the electromagnet and forms a fulcrum for the pivoting movement, the step formation dividing the armature into first and second portions which face the first and second ends respectively, and facing the respective electromagnet in such a position that the second portion of the armature at least partially faces the electromagnet with a gap therebetween, said printer including: a support body on which the armatures are arranged, the support body comprising, for guiding the pivoting movement of each armature, at least one first guide formation which acts on the first end of the armature, at least one second guide formation which acts on the second end of the armature, and at least one positioning formation which acts on the armature closely adjacent the step formation; and a first housing body of thermally conductive material, a second housing body of electrically conductive material for housing the electromagnets, in that the support body is of a thermally insulating material, and at least one of the first and second housing bodies has profiled parts which extend towards the other of the first and second housing bodies, generally to surround the support body, so as to achieve continuity of electrical and thermal conduction between the two housing bodies.

* * * * *